US007516498B2

(12) United States Patent
Torry

(10) Patent No.: US 7,516,498 B2
(45) Date of Patent: Apr. 14, 2009

(54) GARMENT WITH ENHANCED KNEE SUPPORT

(75) Inventor: Michael Ray Torry, Edwards, CO (US)

(73) Assignee: AlignMed, LLC, Santa Ana, CA (US)

( * ) Notice: Subject to any disclaimer, the term of this patent is extended or adjusted under 35 U.S.C. 154(b) by 576 days.

(21) Appl. No.: 11/312,434

(22) Filed: Dec. 21, 2005

(65) Prior Publication Data

US 2006/0130215 A1 Jun. 22, 2006

Related U.S. Application Data

(60) Provisional application No. 60/637,663, filed on Dec. 21, 2004.

(51) Int. Cl.
*A41D 13/00* (2006.01)

(52) U.S. Cl. ..... 2/69; 2/79

(58) Field of Classification Search ..... 2/22–24, 2/69, 242, 911, 62, 79, 227
See application file for complete search history.

(56) References Cited

U.S. PATENT DOCUMENTS

| | | | |
|---|---|---|---|
| 3,670,339 | A | 6/1972 | Cooper et al. |
| 4,035,844 | A | 7/1977 | Atack et al. |
| 4,089,064 | A | 5/1978 | Chandler, Jr. |
| 4,091,466 | A | 5/1978 | Kearn |
| 4,216,547 | A | 8/1980 | Picchione |
| 4,488,314 | A | 12/1984 | Johnson |
| 4,525,875 | A | 7/1985 | Tomczak |
| 4,625,336 | A | 12/1986 | Derderian |
| 4,685,153 | A | 8/1987 | Sims |
| 4,811,727 | A | 3/1989 | Etienne |
| 4,850,056 | A | 7/1989 | Gardner et al. |
| D307,505 | S | 5/1990 | Schiff et al. |
| 5,109,546 | A | 5/1992 | Dicker |
| 5,134,726 | A | 8/1992 | Ross |
| 5,263,923 | A | 11/1993 | Fujimoto |
| 5,267,354 | A | 12/1993 | Grilliot et al. |
| D343,496 | S | 1/1994 | Spoor et al. |
| 5,367,708 | A | 11/1994 | Fujimoto |
| D359,382 | S | 6/1995 | Wiggins |
| 5,431,030 | A | 7/1995 | Ishizaki et al. |
| 5,630,229 | A | 5/1997 | Machado |
| 5,640,714 | A | 6/1997 | Tanaka |
| 5,659,895 | A | 8/1997 | Ford, Jr. |
| 5,727,254 | A | 3/1998 | Dicker |
| 5,737,773 | A | 4/1998 | Dicker et al. |

(Continued)

FOREIGN PATENT DOCUMENTS

| | | | |
|---|---|---|---|
| CN | 2549759 | U | 5/2003 |

(Continued)

OTHER PUBLICATIONS

Notification of Transmittal of International Preliminary Report on Patentability in PCT/US05/46776 dated Feb. 12, 2008, 9 pages.

*Primary Examiner*—Tejash Patel
(74) *Attorney, Agent, or Firm*—Pillsbury Winthrop Shaw Pittman LLP

(57) ABSTRACT

The present invention relates to a garment with enhanced knee support.

28 Claims, 3 Drawing Sheets

U.S. PATENT DOCUMENTS

| | | | |
|---|---|---|---|
| 5,745,917 | A | 5/1998 | Dicker et al. |
| 5,829,058 | A | 11/1998 | Dicker et al. |
| D402,786 | S | 12/1998 | Fujii et al. |
| D404,538 | S | 1/1999 | Fujii et al. |
| D404,889 | S | 2/1999 | Fujii et al. |
| 5,867,826 | A | 2/1999 | Wilkinson |
| 5,875,491 | A | 3/1999 | Wilkinson |
| D413,008 | S | 8/1999 | Fujii et al. |
| 5,937,441 | A | 8/1999 | Raines |
| 5,978,966 | A | 11/1999 | Dicker et al. |
| D420,781 | S | 2/2000 | Fujii et al. |
| 6,047,406 | A | 4/2000 | Dicker et al. |
| 6,053,852 | A | 4/2000 | Wilkinson |
| D424,280 | S | 5/2000 | Fujii et al. |
| D427,750 | S | 7/2000 | Fujii et al. |
| 6,098,209 | A | 8/2000 | Bainbridge et al. |
| 6,142,965 | A | 11/2000 | Mathewson |
| 6,186,970 | B1 | 2/2001 | Fujii et al. |
| 6,305,027 | B2 | 10/2001 | Chou |
| 6,401,497 | B1 | 6/2002 | Nishiyama et al. |
| D460,602 | S | 7/2002 | Tanaka |
| 6,434,749 | B1 | 8/2002 | Grounds et al. |
| D465,078 | S | 11/2002 | Tanaka |
| D465,315 | S | 11/2002 | Tanaka |
| D465,900 | S | 11/2002 | Tanaka |
| D466,674 | S | 12/2002 | Tanaka |
| D481,523 | S | 11/2003 | Hujii et al. |
| D492,837 | S | 7/2004 | Hujii et al. |
| D495,469 | S | 9/2004 | Hujii et al. |
| D503,259 | S | 3/2005 | Ota et al. |
| D504,553 | S | 5/2005 | Ota et al. |
| D505,769 | S | 6/2005 | Ota et al. |
| D505,770 | S | 6/2005 | Ota et al. |
| D507,857 | S | 8/2005 | Ota et al. |
| D507,858 | S | 8/2005 | Ota et al. |
| D508,304 | S | 8/2005 | Ota et al. |
| D512,203 | S | 12/2005 | Ota et al. |
| 7,229,390 | B2 | 6/2007 | Fuji |
| 2002/0152546 | A1 | 10/2002 | Durkin et al. |
| 2003/0101506 | A1 | 6/2003 | Fujii et al. |
| 2004/0107479 | A1 | 6/2004 | Dicker et al. |
| 2004/0111781 | A1 | 6/2004 | Miyake et al. |
| 2004/0255358 | A1 | 12/2004 | Ota et al. |
| 2005/0239370 | A1 | 10/2005 | Oyama et al. |

FOREIGN PATENT DOCUMENTS

| | | |
|---|---|---|
| DE | 33 26 009 | 1/1985 |
| EP | 1 342 423 | 9/2003 |
| JP | 4-50302 | 2/1992 |
| JP | 08-117382 | 5/1996 |
| JP | 2000-045108 | 2/2000 |
| JP | 2001-214303 | 8/2001 |
| JP | 2002-030505 | 1/2002 |
| JP | 2002-054003 | 2/2002 |

GARMENT WITH ENHANCED KNEE SUPPORT

The present application claims priority to U.S. Provisional Application Ser. No. 60/637,663, filed Dec. 21, 2004, the entirety of which is hereby incorporated into the present application by reference.

FIELD OF THE INVENTION

The present invention relates to a garment with enhanced knee support.

BACKGROUND OF THE INVENTION

The knee is particularly vulnerable to injury. It is the joint between the two longest bones of the body, and the entire weight of the body is transferred to the foot through the knee. The knee is also more prone to injury because its stability decreases as it bends. The menisci and the ligaments provide less effective support to the bent knee.

Most sports require walking or running, or some other similar motion like skating, as a component. These sports may require movements that cause lateral shifting of the knee joint (i.e., which may be the femur and tibia shifting relative to one another in opposite directions laterally to the normal plane of motion for the knee joint, or the femur and tibia shifting together laterally to the normal plane of motion of the knee joint), which can lead to injury.

Various approaches have been taken to reduce lateral knee shifting and risk of resultant knee injury. For example, many athletes wear neoprene sleeves around their knees. These sleeves usually cover the entire knee joint area and have the shortcoming of restricting movement. Also, some athletes wear knee braces that have rigid articulating members on the outside of the knees. These braces are cumbersome and also limit movement. Other approaches have suggested garments that mimic taping for providing support. These taping techniques, however, are not designed for healthy knees, and instead are designed to restrict motion in weakened knees. Following them on a healthy knee may inhibit normal knee motion.

The present invention endeavors to provide a garment that provides enhanced knee support for reducing such lateral shifting at the knee joint.

SUMMARY OF THE INVENTION

One aspect of the present invention provides a garment for wearing on the lower body portion of a person. The person's lower body portion includes his/her waist, hips, and at least one leg. The leg includes an upper leg portion joined at one of the person's hips and a lower leg portion hingedly joined to the upper leg portion by a knee. The garment comprises a trunk portion configured to be received over the person's waist and hips when the garment is worn by the person; and a generally tubular leg portion extending downwardly from the trunk portion and configured to be received over the upper leg portion, knee, and at least a substantial portion of the lower leg portion of the person when the garment is worn by the person. The trunk portion and the leg portion comprise a plurality of load transferring sections separated by base sections. At least the base sections are stretchable and resilient so that the trunk portion and the leg portion are tightly fitted when the garment is worn by the person. The load transferring sections have a substantially higher resistance to tensile strain than the base sections.

The load transferring sections comprise:

(a) a knee load distributing ring provided on a front portion of the leg portion, the knee load distributing ring being configured to surround a front of the person's knee when the garment is worn by the person with inner and outer lateral portions of the ring extending on opposing inner and outer lateral sides of the person's leg adjacent the knee, respectively, and upper and lower portions of the ring extending above and below the person's knee, respectively, to connect the inner and outer lateral portions;

(b) an upper anchor portion provided on the trunk or leg portion, the upper anchor portion being configured to be secured substantially above the knee when the garment is worn by the person;

(c) a lower anchor portion provided on the leg portion, the lower anchor portion being configured to be secured substantially below the knee when the garment is worn by the person;

(d) lower lateral support portions that extend downwardly along the inner and outer lateral sides of the person's lower leg portion, respectively, when the garment is worn by the person and connect the inner and outer lateral portions of the knee load distribution ring to the lower anchor portion;

(e) a main support band that extends upwardly along the outer lateral side of the person's upper leg portion when the garment is worn by the person and connects the outer later portion of the knee load distribution ring to the upper anchor portion; and (f) a transverse support band that extends generally transversely across a rear portion of the person's upper leg portion when the garment is worn by the person and connects the inner lateral portion of the knee load distribution ring to the main support band.

These load transferring sections cooperate to resist inward or outward lateral movement of the person's knee when the garment is worn by the person as a result of the connections between the inner and outer lateral portions of the knee load distribution ring and the upper anchor portion and the lower anchor portion.

Other objects, features, and advantages of the present invention will become apparent from the following detailed description, the accompanying drawings, and the appended claims.

DETAILED DESCRIPTION OF AN ILLUSTRATED EMBODIMENT OF THE INVENTION

Figure 1:
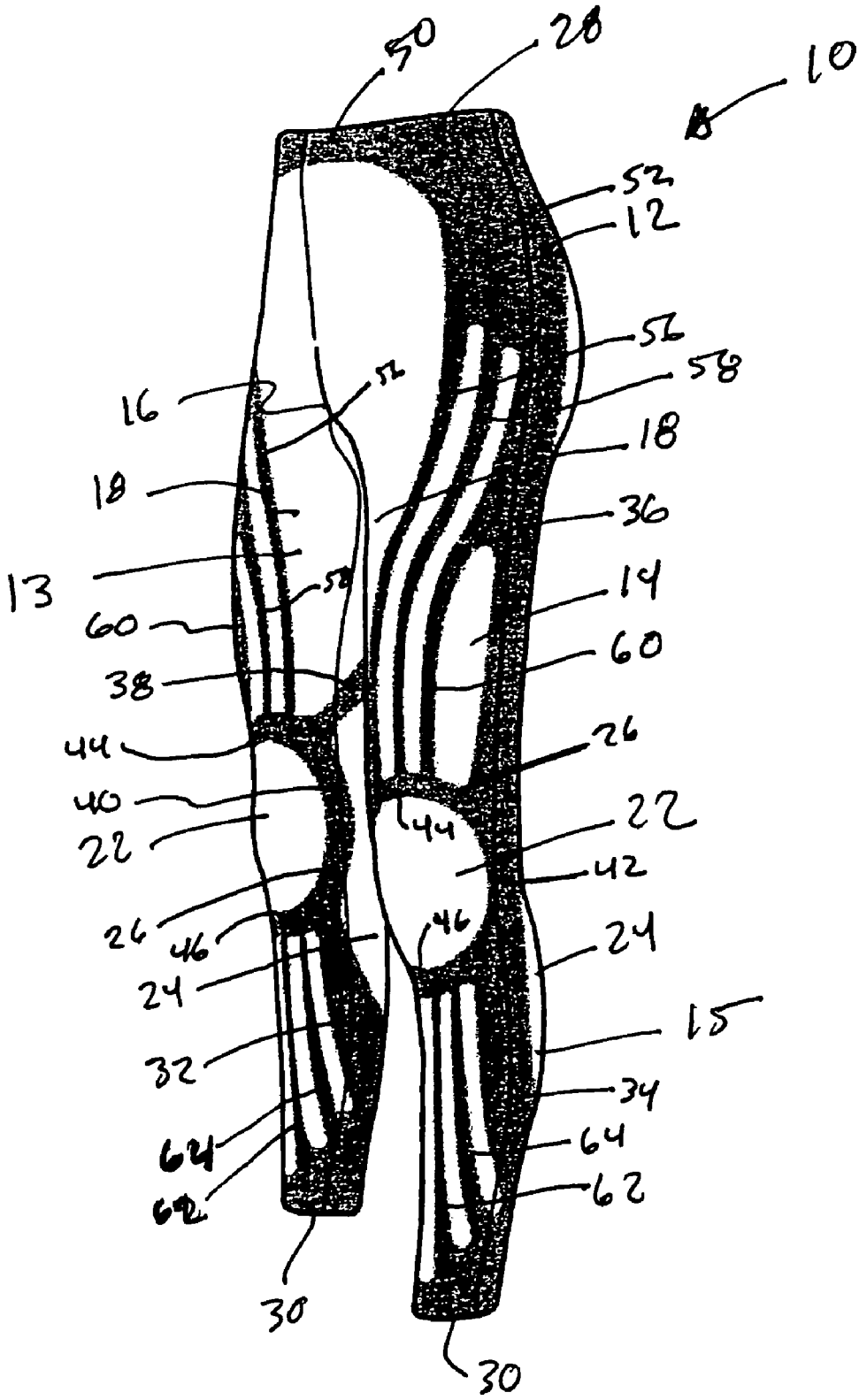
FIG. 1 is a front perspective view of a garment constructed in accordance with the present invention, the garment being shown as it would be worn on a person, with the person not being shown.
Figure 2:
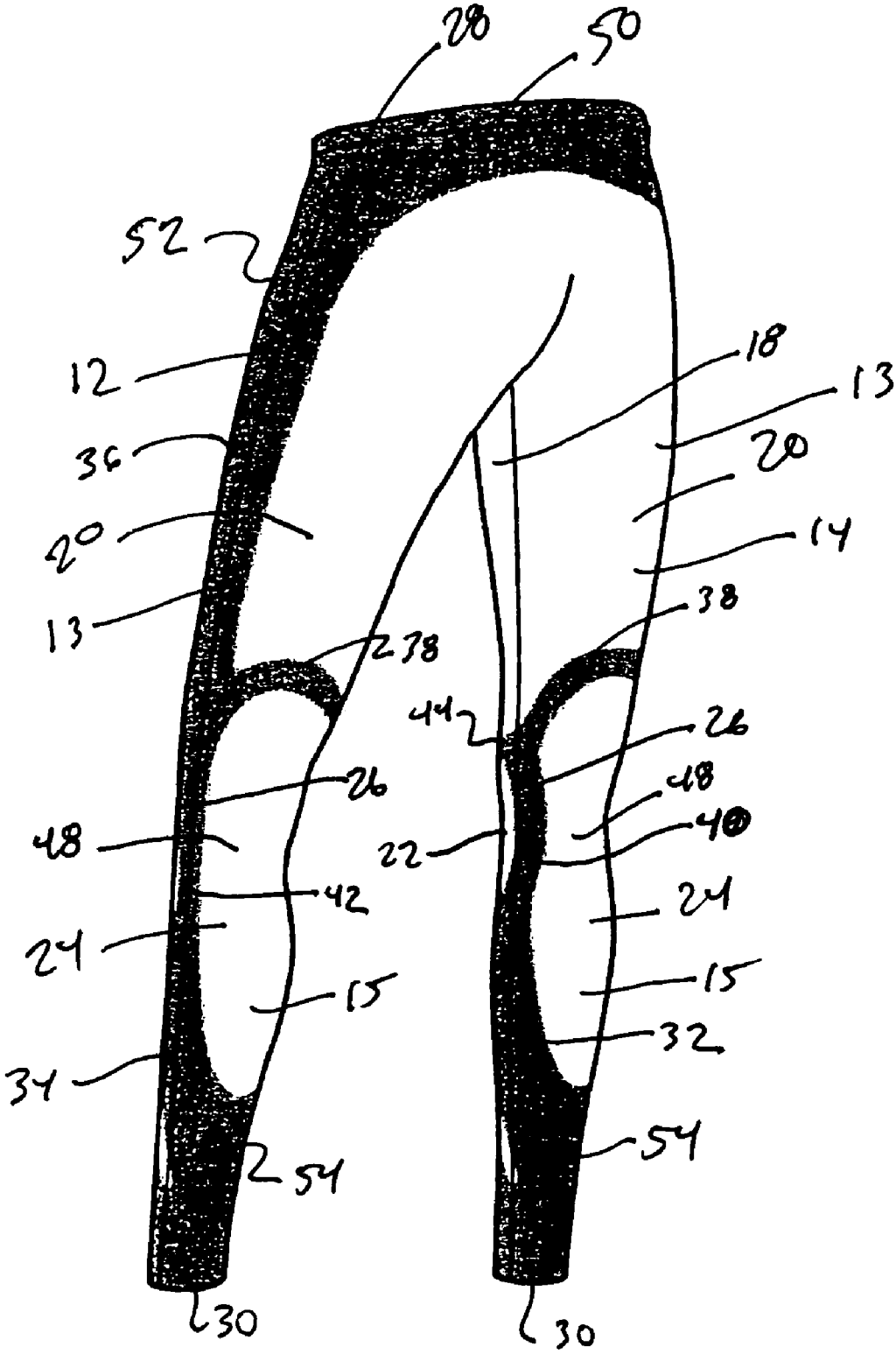
FIG. 2 is a rear perspective view of the garment of FIG. 1.
Figure 3:
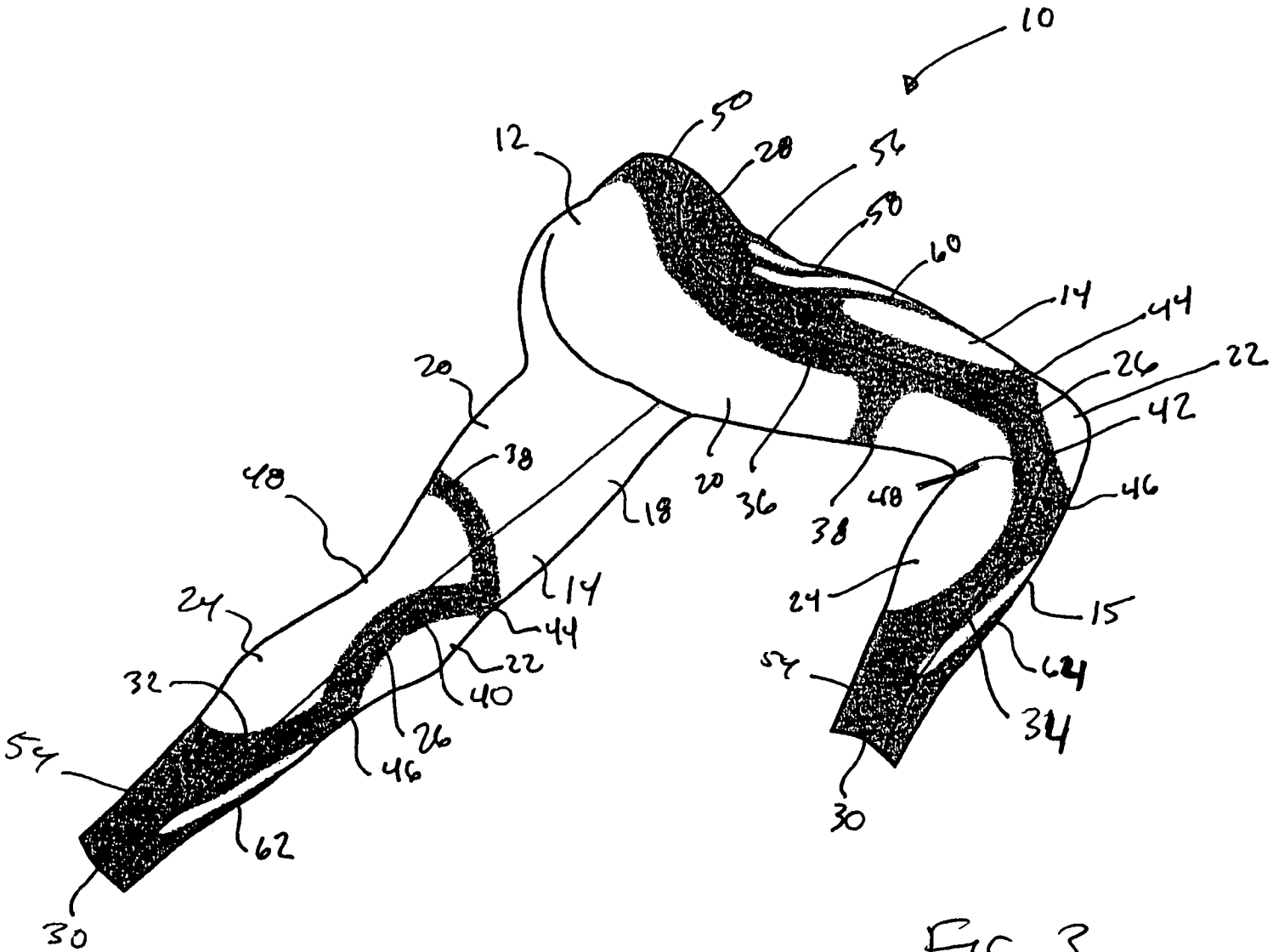
FIG. 3 is a profile view of the garment of FIG. 1, the garment being shown as it would be worn on a person running in mid-stride, with the person not being shown.

The Figures illustrate a garment 10 for wearing on the lower body portion of a person. As is well known, a person's lower body portion includes the person's waist, hips, and one or two legs, and each leg includes an upper leg portion joined at one of the person's hips and a lower leg portion hingedly joined to the upper leg portion at a knee joint. This application does not endeavor to detail the anatomical structure of the person's lower body or knee joint, and reference may be made to various anatomical and medical reference texts for a complete description of such anatomical structure.

Generally, the garment 10 is constructed to provide support to one or both of the knees for the person wearing the garment 10. The garment 10 is suitable for use by athletes, such as football players, skiers, runners, hockey players, etc., that are exposed to a high potential for knee damage from lateral movement injuries. However, the garment 10 may find applicability to person's engaging in less physical types of sports or recreational activities, or it may be used by persons engaging in ordinary activities who desire for whatever reason to have enhanced knee support. It may be desirable for activities where repetition motion occurs, such as running.

The illustrated garment 10 includes a trunk portion 12 configured to be received over the person's waist and hips when the garment is worn by the person. The garment 10 also includes a pair of generally tubular leg portions 14 (one being for the right leg and one being for the left leg). Each leg portion 14 includes an upper leg section 13 and a lower leg portion 15. Each leg portion 14 extends downwardly from the trunk portion 12 and is configured to be received over the upper leg portion, knee, and at least a substantial portion of the lower leg portion of the person when the garment 10 is worn by the person.

The trunk portion 12 may have any shape or configuration suitable to be received over the person's waist and hips. In the illustrated embodiment, the trunk portion 12 has an open topped waist, and the garment 10 is worn similarly to a conventional set of tights. However, the garment 10 may be a full-body suit and the trunk portion 12 may be attached to a part that covers the person's upper body. For example, a full-body garment may be desirable for downhill or cross-country skiers, as they are particularly susceptible to lateral movement knee injuries, and also tend to wear more clothing than athletes in other sports because of cold weather conditions. Likewise, figure skaters, hockey players or speed skaters may desire a full body suit, as they also perform in cold conditions.

The trunk portion 12 and the leg portions 14 include a plurality of load transferring sections separated by base sections. The various load transferring sections are discussed below, and in the illustrated embodiment the base sections account for the remainder of the garment 10. For example, the area 16 covering the crotch, the areas 18 on the inner lateral part of the upper leg portions, the areas 20 on the rear of the upper leg portions, the open area 22 immediately in front of the knee's patella, and the areas 24 that cover the back of the lower leg portion and the back of the knee are all base sections.

In the illustrated garment 10, at least the base sections are stretchable and resilient so that the trunk portion 12 and the leg portions 14 are tightly fitted when the garment is worn by the person. Specifically, the base sections are made of any stretchable fabric that provides a tight fit. An example of such a fabric is LYCRA, which is often used in athletic tights. Other examples include woven or knit fabrics designed to have elastic properties during normal use conditions, such as spandex.

The load transferring sections are designed to have a substantially higher resistance to tensile strain than the base sections. As will be discussed below, the purpose of these load transferring sections is to resist lateral movement of the wearer's knees while minimizing any effect on the wearer's normal leg motion. This is achieved by strategically locating the load transferring sections such that they resist lateral movement of the wearer's knee more effectively than a garment made solely from the material comprising the base sections. The strategic placement of the load transferring sections, however, is designed to minimize any detrimental effect on normal leg motion and athletic performance.

Highly stretchable materials, such as LYCRA or any other material that would be used for the base sections, are desirable in athletic garments because they do not impede normal movement of the legs and hence decreased athletic performance, but they are not very effective at providing support. If the entire garment 10, however, were made from a more resistive material, such as is used for the load transferring sections, there would be more resistance to normal leg movement and hence athletic performance. Thus, in the invention, the load transferring portions have been strategically located to provide enhanced lateral support to the knee, but the remainder of the garment is still made from the base section material to minimize restriction to normal leg movement.

Moreover, because the load transferring sections are designed to have a substantially higher resistance to tensile strain than the base sections, they likely will also have a higher resistance to heat transfer than the base sections. Since athletic movements (e.g., running, jumping, skating, etc.) typically generate a high amount of body heat, it is beneficial to use the strategic location of the load transferring sections so that support is provided to the knee, but allowing a substantial portion of the garment 10 to still be constructed of the base sections. This enables the garment 10 to more effectively allow the wearer's body to dissipate heat (this is often referred to as the garment's "breathing ability"). Different weight fabrics may be used for different applications. For example, a heavier weight material may be used for cold weather sports, and a lighter weight fabric may be used in a garment designed for warmer weather use.

These load transferring sections may be provided with this higher resistance to tensile strain either by being made from a different material with a higher Young's modulus, or by using the same material as the base section, but providing the load transferring sections with a thicker cross-sectional area and hence a higher resistance to tensile strain. Examples of such a material with a higher Young's modulus include neoprene, nylon non-stretch fabrics, etc. It is preferred that the load transferring sections have some resiliency or stretchability to ensure that they tightly fit against the wearer, but not necessarily as much resiliency or stretchability as the base sections. Alternatively, if the load transferring sections have a low resiliency, the resiliency of the base sections can be used for tightly fitting the load transferring sections against the wearer's body.

In the illustrated embodiment, the load transferring sections comprise a knee load distributing ring 26 for each leg portion 14, an upper anchor portion 28, a lower anchor ring 30 for each leg portion 14, lower lateral support portions 32, 34 for each leg portion 14, a main support band 36 for each leg portion 14, and a transverse support band 38 for each leg portion 14.

The knee load distributing ring 26 is provided on a front portion of the leg portion 14. The knee load distributing ring 26 is configured to surround a front of the person's knee as illustrated when the garment 10 is worn by the person. As is illustrated, when the garment 10 is worn, inner and outer lateral portions 40, 42 of the ring extend on opposing inner and outer lateral sides of the person's leg adjacent the knee; and upper and lower portions 44, 46 of the ring 26 extend above and below the person's knee, respectively, to connect the inner and outer lateral portions 40, 42.

It can be appreciated that the ring 26 is not part of a sleeve that is made entirely of a highly resistive material and surrounds the whole leg just at the knee, which is an approach used in some devices such as knee sleeves made from NEOPRENE. Instead, the leg portions 14 are preferably devoid of the load transferring sections in the rear knee areas 48 that are positioned directly opposite the person's knee when the garment is worn by the person. Also, the central opening in the ring 26 is preferably devoid of the load transferring sections. This construction allows the knee to be bent in a normal manner without the resistance that would be encountered if the load transferring sections occupied these areas. That is, open center of the ring 26 allows the patella protrude slightly forward therethough when the leg is bent in a normal running or walking motion (i.e., where the upper and lower flex in essentially the same plane about the knee joint). Likewise, removing any load transferring material from the rear of the knee joint prevents reduces the restriction in motion that are seen in most "sleeve" type devices.

The upper anchor portion 28 is provided on the trunk portion 12 (or possibly the upper leg section). The upper anchor portion 28 is configured to be received tightly on the person's hip when the garment 10 is worn by the person. In the illustrated embodiment, this is achieved by the upper anchor portion 28 including or being part of an upper waist ring 50 configured to surround the person's waist tightly when the garment is worn by the person. A pair of relatively wide connection portions 52 extend downwardly from the upper waist ring 50. The purpose of the upper anchor portion 28 is to provide a connection point for the main support band 36 and any other load transferring sections that may be connected to it. This connection allows those sections to resist movement along the wearer's leg better, and when a tensile load is applied to those sections, it can be transferred to the upper anchor portion 28 for increased resistance to movement. The tight fit of the upper anchor portion 28 provided by the upper waist ring 50 provides a sufficiently stable connection point. Alternatively, the waist ring 50 may be omitted, and separate upper anchor portions could be provided on the opposing lateral side of the wearer's hips. These upper anchor portions would preferably be tightly fitted to the wearer's hips and have a sufficiently large surface area such that free sliding movement of these anchor portions would be reduced or minimized. This alternative arrangement would also provide a suitably stable connection point.

The lower anchor rings 30 are provided on the leg portion 14 and are configured to tightly surround a portion of the person's lower leg substantially below the knee when the garment 10 is worn by the person. These rings 30 are preferably located to surround the wearer's ankles, but may be located higher up on the wearer's calf. As an alternative, they may be supplemented with stirrups to pass under the wearer's feet to help keep the garment 10 fully stretched and tightly fitted on the wearer. Similarly to the upper anchor portion 28, the purpose of these lower anchor rings 30 is to provide a connection point for the lower lateral support portions 32, 34 and any other load transferring sections that may be connected to it. This connection allows those sections to resist movement along the wearer's leg better, and when a tensile load is applied to those sections, it can be transferred to the respective lower anchor ring 30 for increased resistance to movement. The tight fit of the lower anchor rings 30 provides a sufficiently stable connection point. Optionally, the lower anchor rings may provide support to the wearer's Achilles tendon.

Instead of using lower anchor rings 30, any suitable lower anchor portion sewn substantially below the knee may be used. For example, stirrups secured by passing under a wearer's foot may be used.

The lower lateral support portions 32, 34 extend downwardly along the inner and outer lateral sides of the person's lower leg portion, respectively, when the garment is worn by the person. They connect the inner and outer lateral portions 40, 42 of the knee load distribution rings 26 to the lower load anchor rings 30. As illustrated, the lower lateral support portions 32, 34 extend along the inner and outer lateral sides of the garment's lower leg portion 15 from the region where the inner and outer lateral portions 40, 42 meet the lower portions 46 of the rings 26. They connect to the lower anchor rings 30 at the laterals sides thereof. Specifically, the lower anchor rings 30 have a rear connection portion 54 that extends upwardly along the rear portion of the garment's lower leg portion 15, and the lower lateral support portions 32, 34 curve slightly rearwardly to connect with those rear connection portions 54.

The main support bands 36 extend upwardly along the outer lateral side of the person's upper leg portion when the garment 10 is worn by the person. These bands 36 connect the outer later portions 42 of the knee load distribution rings 26 to the upper anchor portion 28. As illustrated, these bands 36 merge with and connect to the connection portions 52 of the upper anchor portion 28 and extend along the outer lateral sides of the garment's upper leg portions 13 to the region where the outer lateral portions 42 meet the upper portions 46 of the knee load distributing 26. In the illustrated embodiment, the transition in this region is such that the main support bands 26, the outer lateral portions 42, and the outer lower lateral support portions 34 are formed continuously together, as can be seen in the Figures.

The transverse support bands 38 extend generally transversely across a rear portion of the person's upper leg portion when the garment is worn by the person. These transverse support bands 38 connect the inner lateral portions 40 of the knee load distribution rings 26 to the main support bands 36. In the illustrated embodiment, these bands 38 extend from the areas where the inner lateral portions 40 and the upper portions 46 of the knee load distributing ring 26 meet, and traverse across the back of the upper leg portions 13 to join with the main support bands 36 approximately ⅓ of the way up the upper leg portions 13. As illustrated, these bands 38 intersect the main support bands 36 at approximately a 90 degree angle, and have a slight curvature extending upwardly from their connections with the knee load distributing rings 26. This curvature may optionally help to maintain correct positioning of the bands 38 below the hamstring so that the hamstring is not compressed or restricted.

These load transferring sections discussed above cooperate to resist inward or outward lateral movement of the person's knee when the garment is worn by the person as a result of the connections between the inner and outer lateral portions 40, 42 of the knee load distribution ring 26 and the upper anchor portion 28 and the lower anchor rings 30.

Specifically, in a situation where the wearer's knee is subject to an inward lateral shifting load, the knee pushes inward against the inner lateral portion 40 of the knee load distributing ring 26. The inward movement of the inner lateral portion 40 is resisted by a portion of the load being transferred in tension to the transverse support band 38 and the inner lower lateral support portion 32, which in turn may transfer that portion of the load to the main support band 36 and the lower anchor ring 30. The main support band 36 in turn may transfer that portion of the load from the transverse support band 38 to the upper anchor portion 28. Likewise, the inward movement of the inner lateral portion 40 is also resisted by a portion of the load being transferred in tension to the upper and lower portions 44, 46 of the knee load distributing ring 26, which in turn transfers their portion of the load to the main support band 36 and outer lower lateral support portion 34 by their connections to the ring 26. These portions 36 and 34 likewise may transfer that portion of load to the lower anchor ring 30 and the upper anchor portion 28. The extent of the load transfer is generally a function of the load applied and the materials used.

Likewise, in a situation where the wearer's knee is subject to an outward lateral shifting load, the knee pushes outward against the outer lateral portion 42 of the knee load distributing ring 26. The outward movement of the outer lateral portion 42 is resisted by a portion of the load being transferred in tension to the main support band 36 and the outer lower lateral support portion 34, which in turn may transfer that portion of the load to the upper anchor portion 28 and the lower anchor ring 30. The outward movement of the outer lateral portion 42 is also resisted by a portion of the load being transferred in tension to the upper and lower portions 44, 46 of the knee load distributing ring 26, which in turn may transfer their portion of the load to the transverse support band 38 and the inner lower lateral support portion 32 by their connections to the ring 26. The main support band 36 in turn may transfer that portion of the load from the transverse support band 38 to the upper anchor portion 28. The extent of the load transfer is generally a function of the load applied and the materials used.

As such, these load supporting sections function as a 4-point support system that efficiently and effectively resists either inner or outer lateral shifting movement of the knee by supporting the inner and outer lateral portions 40, 42 of the ring 26 against such lateral movement, and transferring load by various paths to the more stable upper anchor portion 28 and lower anchor ring 30. By providing these load transferring sections with a substantially higher resistance to tensile strain than the base sections, the effectiveness of this supporting function is enhanced and knee injuries resulting from lateral shifting motion can be reduced. Moreover, because of the strategic placement of these load supporting sections, discussed above, the remainder of the garment 10 can be made of a more resilient material, thus minimizing any effect on athletic performance.

The use of various connection points for the knee load distributing ring 26 also helps to keep the ring 26 properly positioned (i.e., centered on the knee).

Generally, these load transferring sections may be arranged in any suitable manner to provide support to the knee load distributing ring 26. For example, the sections may be thinner or thicker, or otherwise have different configurations, or be arranged on the garment 10 differently from that shown in the figures. Specifically, for different uses, the arrangement, configuration and/or load bearing characteristics of the load transferring sections may be tailored as desired. In sports such as football, where athletes often change running directions dramatically in mid-stride, and often on unforgiving surfaces such as artificial turf, it may be beneficial to increase the support provided to the knee supporting ring 26. Likewise, for other sports where there is less risk of knee injury, the support provided to the knee supporting ring 26 could be reduced by using smaller or less strong transferring sections to allow for freer movement of the legs while still providing some support.

As an optional feature, other load transferring sections can be used to provide further support to the knee load distributing ring 26. These are discussed below.

For example, the load transferring sections may include a plurality of upper supplemental bands 56, 58, 60 spaced apart from one another. These bands 56, 58, 60 extend upwardly along a front of the person's upper leg portions when the garment 10 is worn by the person. Specifically, they extend along the upper leg portions 13 of the garment 10 and connect the upper portions 44 of the knee load distribution rings 26 to the upper anchor portions 28. In the illustrated embodiment, bands 56 and 58 connect directly to the connecting portions 52 of the upper anchor portions 28, and bands 60 are indirectly connected to the connecting portions 52 by being connected to an upper part of each main supporting band 36.

These supplemental bands 56, 58, 60 assist in properly locating the knee supporting rings 26 about the wearer's knees, and keep the upper portions 44 of the rings 26 relatively taut so that they can effectively transfer load between the inner and outer lateral portions 40, 42 as discussed above. Further, when there is lateral knee shifting, and the upper portion 44 is subject to tension, these support bands 56, 58, 60 help prevent the upper portion 44 of the ring 26 from straightening from its curved configuration. That is, if the upper portion 44 were allowed to straighten significantly when subject to tension, it may not effectively transfer the lateral loading to the opposing lateral portion 40 or 42 and to the main support or transverse bands 36, 38 (or the effectiveness may be reduced). Instead, it will initially straighten before transferring load to those bands 36, 38, which reduces its effectiveness in resisting movement of the appropriate inner or outer lateral portion 40, 42 of the ring 26. By using these supplemental bands 56, 58, 60 to prevent such straightening, the upper lateral portion 44 will more effectively transfer load and resist lateral movement of the inner and outer lateral portions 40, 42. Instead of using multiple supplemental bands, this effect could be achieved with one upper supplemental band, and thus this optional feature can encompass any arrangement with at least one upper supplemental band.

Also, the load transferring sections may include a plurality of lower supplemental bands 62, 64 spaced apart from one another. These bands 62, 64 extend upwardly along a front of the person's lower leg portions when the garment 10 is worn by the person. Specifically, these bands 62, 64 extend along the front of the garment's lower leg portions 15 and connect the lower portions 46 of the knee load distribution rings 26 to the lower anchor rings 30.

Like the upper supplemental bands 56, 58, 60, these lower supplemental bands 62, 64 function to assist in properly locating the knee supporting rings 26 about the wearer's knees, and keep the lower portions 46 of the rings 26 relatively taut so that they can effectively transfer load between the inner and outer lateral portions 40, 42 as discussed above. Further, when there is lateral knee shifting, and the lower portion 46 is subject to tension, these support bands 60, 62 help prevent the lower portion 46 of the ring 28 from straightening from its curved configuration. That is, as with the upper portion 44, if the lower portion 46 were allowed to straighten significantly when subject to tension, it may not effectively transfer the lateral loading and resist lateral movement (or the effectiveness may be reduced). By using these supplemental bands 62, 64 to prevent such straightening, the lower lateral portion 46 will more effectively transfer load as discussed above. Instead of using multiple supplemental bands, this effect could be achieved with one lower supplemental band, and thus this optional feature can encompass any arrangement with at least one lower supplemental band.

The use of these supplement bands is optional, but preferred because it enhances the support afforded by the illustrated construction.

Also, instead of using separate lower lateral support portions 32, 34 and the supplemental bands 60, 62, these sections could each be replaced with one continuous load transferring section that extends along the front and lateral sides of the lower leg portion 15 of the garment 10 and connects to the lower anchor ring 30. In that case, the lateral sides of this section would be regarded as the lower lateral support portions 32, 34, as they would still be the portions transferring the load to the lower anchor ring 30. The function of the lower supplemental bands 60, 62 would be performed by the front center portion of such a section, which would still assist with preventing straightening of the lower portion 46 of the ring 26. Such an arrangement is considered as a viable alternative, as the front portion of the lower leg (i.e., the shin) does not have significant musculature or articulating joints that play a significant role in athletic leg movements, such as running or skating, and freedom of motion is less of a concern. In such an arrangement, the lower anchor rings 30 may appear to be continuous with that section, and may be not be separately identifiable from an aesthetics standpoint. However, the lower end of the section that encircles the wearer's leg would still be regarded as a lower anchor ring as it still encircles the leg and assists in resisting movement of the remainder of the section, and in turn the knee load distributing ring 28.

The base sections and load transferring sections of the garment 10 may be assembled together in any suitable way. For example, in one approach, the entire garment 10 may be made from the base section, such as LYCRA, and the load transferring sections would be laminated onto the garment 10 by any suitable heat bonding or chemical bonding operation, or by a mechanical connection such as stitching. Also, in another approach, the base sections and load transferring sections could be provided in individual sections or panels and assembled together at their edges. The first approach is preferred because it is easier and more cost-effective from a manufacturing standpoint, and because garments made entirely of the base sections, such as those made from LYCRA, are widely commercially available.

Although the garment 10 illustrated in the Figures has two legs, it is within the scope of the invention to create a one-legged embodiment. This may be desirable for different applications. For example, a person entering rehabilitation after a recent leg amputation may benefit from the knee support provided by the garment to his/her remaining leg, particularly if he/she is in the rehabilitation process and is adjusting to moving about on one leg with the assistance of crutches. Likewise, a football kicker or punter may benefit from a one-legged garment, as he may desire to have one-leg completely free from the garment for kicking purposes. However, kickers and punters occasionally must engage in physical contact in the course of a football game by making tackles, being blocked the opposing team, or executing fake punts or kicks, and may benefit from having the added support on the non-kicking leg. Moreover, kickers and punters place themselves in a very vulnerable position when opposing players attempt to block their kicks, as they are typically supporting themselves only on their non-kicking leg at that time. Added knee support can be beneficial if the opposing player inadvertently knocks the kicker or punter off-balance as part of an attempt to block a kick.

The foregoing illustrated embodiment has been provided to illustrate the structural and functional principles of the present invention, and should not be considered as limiting. To the contrary, the present invention encompasses all variations, substitutions, alterations, modifications, and equivalents.

What is claimed:

1. A garment for wearing on the lower body portion of a person, the lower body portion including the person's waist, hips, and at least one leg, the leg including an upper leg portion joined at one of the person's hips and a lower leg portion hingedly joined to the upper leg portion by a knee, the garment comprising:

a trunk portion configured to be received over the person's waist and hips when the garment is worn by the person;

a generally tubular leg portion extending downwardly from the trunk portion and configured to be received over the upper leg portion, knee, and at least a substantial portion of the lower leg portion of the person when the garment is worn by the person;

the trunk portion and the leg portion comprising a plurality of load transferring sections separated by base sections, at least the base sections being stretchable and resilient so that the trunk portion and the leg portion are tightly fitted when the garment is worn by the person, the load transferring sections having a substantially higher resistance to tensile strain than the base sections;

wherein said load transferring sections comprise:

(a) a knee load distributing ring provided on a front portion of the leg portion and including upper and lower portions and inner and outer lateral portions between the upper and lower portions, the knee load distributing ring being configured to surround a front of the person's knee when the garment is worn by the person with the inner and outer lateral portions of the ring extending on opposing inner and outer lateral sides of the person's leg adjacent the knee, respectively, and the upper and lower portions of the ring extending above and below the person's knee, respectively, to connect the inner and outer lateral portions;

(b) an upper anchor portion provided on the trunk or leg portion, the upper anchor portion being secured substantially above the person's knee when the garment is worn by the person;

(c) a lower anchor portion provided on the leg portion, the lower anchor portion being configured to be secured substantially below the person's knee when the garment is worn by the person;

(d) lower lateral support portions that extend downwardly along the inner and outer lateral sides of the person's lower leg portion, respectively, when the garment is worn by the person and connect the inner and outer lateral portions of the knee load distributing ring to the lower anchor portion;

(e) a main support band that extends upwardly along the outer lateral side of the person's upper leg portion when the garment is worn by the person and connects the outer later portion of the knee load distributing ring to the upper anchor portion; and (f) a transverse support band that extends generally transversely across a rear portion of the person's upper leg portion when the garment is worn by the person and connects the inner lateral portion of the knee load distributing ring to the main support band;

wherein said load transferring sections are configured to cooperate to resist inward or outward lateral movement of the person's knee when the garment is worn by the person as a result of the connections between the inner and outer lateral portions of the knee load distributing ring and the upper anchor portion and the lower anchor portion.

2. A garment according to claim 1, wherein the upper anchor portion is configured to be received tightly on the person's hip when the garment is worn by the person.

3. A garment according to claim 2, wherein the upper anchor portion includes an upper waist ring configured to surround the person's waist tightly when the garment is worn by the person.

4. A garment according to claim 3, wherein the load transferring sections includes at least one upper supplemental band that extends upwardly along a front of the person's upper leg portion when the garment is worn by the person and connects the upper portion of the knee load distribution ring to the upper anchor portion.

5. A garment according to claim 4, wherein the load transferring sections include a plurality of said upper supplemental bands spaced apart from one another.

6. A garment according to claim 1, wherein the lower lateral support portions comprise:

an inner lower support band that extends downwardly along the inner lateral side of the person's lower leg portion when the garment is worn by the person and connects the inner lateral portion of the knee load distributing ring to the lower load anchor portion; and an outer lower support band that extends downwardly along the outer lateral side of the person's lower leg portion when the garment is worn by the person and connects the outer lateral portion of the knee load distributing ring to the lower load anchor portion.

7. A garment according to claim 6, wherein the load transferring sections includes at least one lower supplemental band that extends upwardly along a front of the person's lower leg portion when the garment is worn by the person and connects the lower portion of the knee load distributing ring to the lower anchor portion.

8. A garment according to claim 7, wherein the load transferring sections include a plurality of said lower supplemental bands spaced apart from one another.

9. A garment according to claim 2, wherein the lower lateral support portions comprise:

an inner lower support band that extends downwardly along the inner lateral side of the person's lower leg portion when the garment is worn by the person and connects the inner lateral portion of the knee load distributing ring to the lower load anchor portion; and an outer lower support band that extends downwardly along the outer lateral side of the person's lower leg portion when the garment is worn by the person and connects the outer lateral portion of the knee load distributing ring to the lower load anchor portion.

10. A garment according to claim 9, wherein the load transferring sections includes at least one lower supplemental band that extends upwardly along a front of the person's lower leg portion when the garment is worn by the person and connects the lower portion of the knee load distributing ring to the lower anchor portion.

11. A garment according to claim 10, wherein the load transferring sections include a plurality of said lower supplemental bands spaced apart from one another.

12. A garment according to claim 3, wherein the lower lateral support portions comprise:

an inner lower support band that extends downwardly along the inner lateral side of the person's lower leg portion when the garment is worn by the person and connects the inner lateral portion of the knee load distributing ring to the lower load anchor portion; and an outer lower support band that extends downwardly along the outer lateral side of the person's lower leg portion when the garment is worn by the person and connects the outer lateral portion of the knee load distributing ring to the lower load anchor portion.

13. A garment according to claim 12, wherein the load transferring sections includes at least one lower supplemental band that extends upwardly along a front of the person's lower leg portion when the garment is worn by the person and connects the lower portion of the knee load distributing ring to the lower anchor portion.

14. A garment according to claim 13, wherein the load transferring sections include a plurality of said lower supplemental bands spaced apart from one another.

15. A garment according to claim 4, wherein the lower lateral support portions comprise:

an inner lower support band that extends downwardly along the inner lateral side of the person's lower leg portion when the garment is worn by the person and connects the inner lateral portion of the knee load distributing ring to the lower load anchor portion; and an outer lower support band that extends downwardly along the outer lateral side of the person's lower leg portion when the garment is worn by the person and connects the outer lateral portion of the knee load distributing ring to the lower load anchor portion.

16. A garment according to claim 15, wherein the load transferring sections includes at least one lower supplemental band that extends upwardly along a front of the person's lower leg portion when the garment is worn by the person and connects the lower portion of the knee load distributing ring to the lower anchor portion.

17. A garment according to claim 16, wherein the load transferring sections include a plurality of said lower supplemental bands spaced apart from one another.

18. A garment according to claim 5, wherein the lower lateral support portions comprise:

an inner lower support band that extends downwardly along the inner lateral side of the person's lower leg portion when the garment is worn by the person and connects the inner lateral portion of the knee load distributing ring to the lower load anchor portion; and an outer lower support band that extends downwardly along the outer lateral side of the person's lower leg portion when the garment is worn by the person and connects the outer lateral portion of the knee load distributing ring to the lower load anchor portion.

19. A garment according to claim 18, wherein the load transferring sections includes at least one lower supplemental band that extends upwardly along a front of the person's lower leg portion when the garment is worn by the person and connects the lower portion of the knee load distributing ring to the lower anchor portion.

20. A garment according to claim 19, wherein the load transferring sections include a plurality of said lower supplemental bands spaced apart from one another.

21. A garment according to claim 1, wherein the lower anchor portion is a lower anchor ring configured to tightly surround a portion of the person's lower leg substantially below the knee when the garment is worn by the person.

22. A garment according to claim 6, wherein the lower anchor portion is a lower anchor ring configured to tightly surround a portion of the person's lower leg substantially below the knee when the garment is worn by the person.

23. A garment according to claim 9, wherein the lower anchor portion is a lower anchor ring configured to tightly surround a portion of the person's lower leg substantially below the knee when the garment is worn by the person.

24. A garment according to claim 12, wherein the lower anchor portion is a lower anchor ring configured to tightly surround a portion of the person's lower leg substantially below the knee when the garment is worn by the person.

25. A garment according to claim 15, wherein the lower anchor portion is a lower anchor ring configured to tightly surround a portion of the person's lower leg substantially below the knee when the garment is worn by the person.

26. A garment for wearing on the lower body portion of a person, the lower body portion including the person's waist, hips, and at least one leg, the leg including an upper leg portion joined at one of the person's hips and a lower leg portion hingedly joined to the upper leg portion by a knee, the garment comprising:

a generally tubular leg portion configured to be received over at least a substantial portion of the upper leg portion, the knee, and at least a substantial portion of the lower leg portion of the person when the garment is worn by the person;

a plurality of load transferring sections separated by base sections, at least the base sections being stretchable and resilient so that the garment is tightly fitted when the worn by the person, the load transferring sections having a substantially higher resistance to tensile strain than the base sections;

wherein said load transferring sections comprise:

(a) a knee load distributing ring provided on a front portion of the leg portion and including upper and lower portions and inner and outer lateral portions between the upper and lower portions, the knee load distributing ring being configured to surround a front of the person's knee when the garment is worn by the person with the inner and outer lateral portions of the ring extending on opposing inner and outer lateral sides of the person's leg adjacent the knee, respectively, and the upper and lower portions of the ring extending above and below the person's knee, respectively, to connect the inner and outer lateral portions;

(b) an upper anchor portion configured to be secured substantially above the person's knee when the garment is worn by the person;

(c) a lower anchor portion configured to be secured substantially below the person's knee when the garment is worn by the person; and (d) a plurality of support portions connected between the knee load distributing ring and the upper and lower anchor portions;

wherein said load transferring sections are configured to cooperate to resist inward or outward lateral movement of the person's knee when the garment is worn by the person as a result of the connections the knee load distributing ring and the upper anchor portion and the lower anchor portion, and wherein said ring has an open center devoid of a load transferring section and the leg portion is also devoid of a load transferring section opposite the knee load distributing ring.

27. A garment according to claim 26, wherein the plurality of support portions comprises a plurality of elongated bands connected between the knee load distributing ring and the upper and lower anchor portions.

28. A garment to claim 26, wherein the plurality of support portions comprises:

(a) lower lateral support portions that extend downwardly along the inner and outer lateral sides of the person's lower leg portion, respectively, when the garment is worn by the person and connect the inner and outer lateral portions of the knee load distributing ring to the lower anchor portion;

(b) a main support band that extends upwardly along the outer lateral side of the person's upper leg portion when the garment is worn by the person and connects the outer later portion of the knee load distributing ring to the upper anchor portion; and (c) a transverse support band that extends generally transversely across a rear portion of the person's upper leg portion when the garment is worn by the person and connects the inner lateral portion of the knee load distributing ring to the main support band.

* * * * *